US007856686B2

(12) United States Patent
Cho

(10) Patent No.: US 7,856,686 B2
(45) Date of Patent: Dec. 28, 2010

(54) SELF-ADJUSTING PILLOW

(76) Inventor: Kwong Ming Cho, Flat F, 3/F, Block 5, Harmony Garden, 9 Siu Sai Wan Road, Siu Sai Wan (HK)

( * ) Notice: Subject to any disclaimer, the term of this patent is extended or adjusted under 35 U.S.C. 154(b) by 0 days.

(21) Appl. No.: 12/574,627

(22) Filed: Oct. 6, 2009

(65) Prior Publication Data

US 2010/0017966 A1 Jan. 28, 2010

Related U.S. Application Data

(63) Continuation of application No. 11/536,998, filed on Sep. 29, 2006, now abandoned.

(51) Int. Cl.
*A47G 9/00* (2006.01)

(52) U.S. Cl. ..... 5/636; 5/640; 5/630

(58) Field of Classification Search ..... 5/636, 5/630, 639, 640, 644
See application file for complete search history.

(56) References Cited

U.S. PATENT DOCUMENTS 3,469,882 A * 9/1969 Larsen ..... 297/118
6,006,380 A * 12/1999 Sramek ..... 5/636

* cited by examiner

*Primary Examiner*—Fredrick Conley
(74) *Attorney, Agent, or Firm*—J.C. Patents

(57) ABSTRACT

A self-adjusting pillow includes a pillow portion and an adjustment portion below the pillow portion. The adjustment portion includes a planar portion and an arc portion connected with the planar portion, the planar portion being connected with the pillow portion. The longitudinal section of the adjustment portion has a shape of the letter "D" when the height direction of the person lying on the pillow is taken as the longitudinal direction.

1 Claim, 1 Drawing Sheet

SELF-ADJUSTING PILLOW

CROSS-REFERENCE TO RELATED APPLICATION

This application is a continuation of application Ser. No. 11/536,998 filed on Sep. 29, 2006, which in turn claims priority benefit of Hong Kong Short-Term Application No. 06108389.6 filed on Jul. 28, 2006. The contents of the above prior applications are hereby incorporated by reference in their entirety.

TECHNICAL FIELD

The invention relates to a pillow, and more particularly, to a self-adjusting pillow, the height of which is self-adjusted in accordance with the sleeping posture of the user without exerting any spring-back pressure.

BACKGROUND OF THE INVENTION

People spend one third of their life times sleeping in the dreams, and sleeping is the most usual way for the human body to have a rest. For this reason, people are always trying their best to find a way to make themselves sleep more comfortable, so a variety of pillows are available in the marketplaces. However, some pillows have such a weak supporting force that the pillow caves in as soon as the user's head puts on the pillow, and the user's head feels like not being supported on it; some pillows have such a strong supporting force that the pillow user feels neck-stiff and cannot turn his neck around when he wakes up due to too strong spring-back force exerted on his neck by the pillow.

The suitable height of pillow is such that, the neck, the cervical vertebra and the backbone of the user are aligned with his head when sleeping on the pillow. When the pillow user lies on his back, he needs a pillow height different from that needed when he lies on his side. A nice pillow is such a pillow, the height of which can be suitably adjusted, so as to accommodate different sleeping postures.

Some different types of pillows are disclosed in the related items in Chinese Utility Model patent (Publication Number) CN 2524605, 2671613, 2162865, 2501409 and 2482913. However, none of these types of pillow is able to solve the above-described problem, that is, the height of the pillow is capable of self-adjusting to meet the requirements of different sleeping postures while not exerting any spring-back pressure.

SUMMARY OF THE INVENTION

In order to overcome the problems existing in the prior art, the object of the present invention is to provide a self-adjusting pillow, the height of which can be self-adjusted in accordance with different sleeping postures during the user's sleeping process without exerting any spring-back pressure.

In order to achieve the above-described object, the pillow according to the present invention includes a pillow portion and an adjustment portion below the pillow portion. The adjustment portion further includes a planar portion and an arc portion connected with the planar portion. The planar portion is connected with the pillow portion. When the height direction of the person lying on the pillow is taken as the longitudinal direction, the longitudinal section of the adjustment portion has the shape of the letter "D".

The cross section of the adjustment portion is rectangle in shape.

The curve of the outer upper surface of the pillow portion is matched with the curve of the head, the neck and the shoulder of the person. The maximum height of the adjustment portion is about 5 cm.

In a preferred embodiment, the size of the lower surface of the pillow portion is larger than the corresponding size of the planar portion connected therewith.

In another preferred embodiment, one or more adjustment thin layers can be included between the pillow portion and the adjustment portion.

The self-adjusting pillow according to the present invention enables the cervical vertebra of the person who uses it to be effectively supported on the pillow during his sleep, and ensures that he can enjoy an excellent sleep, so that he will be energetic when he wakes up and will reduce unnecessary neck sufferings.

DESCRIPTION OF THE DRAWINGS

The detailed description of the present invention will be made with reference to the accompanying drawings, wherein.

DETAILED DESCRIPTION OF PREFERRED EMBODIMENT(S)

Figure 1:
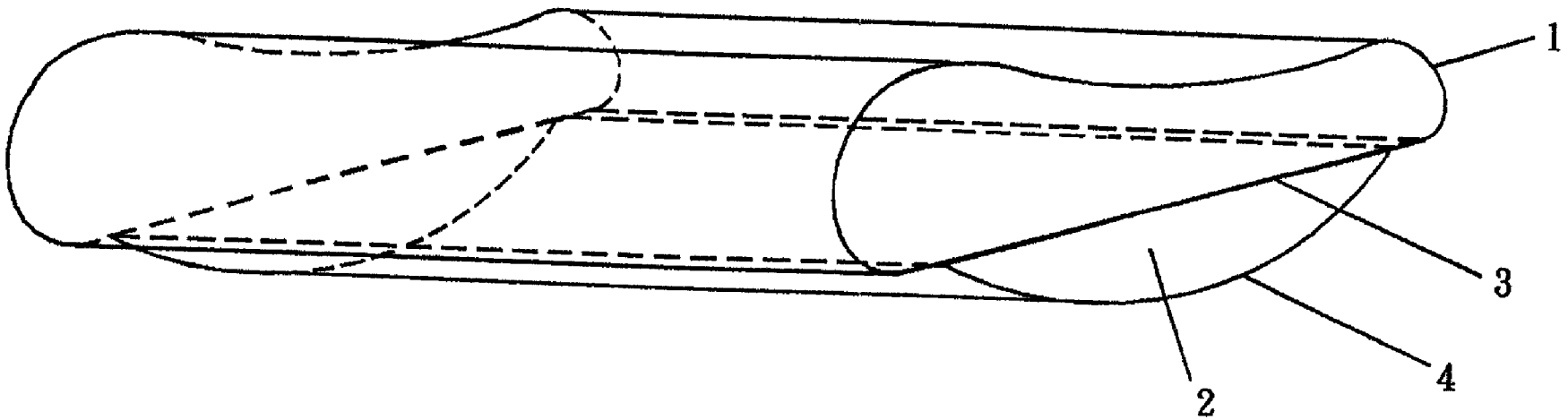
FIG. 1 shows a schematic view of the self-adjusting pillow according to the present invention.

As shown in the drawings, the self-adjusting pillow according to the present invention includes a pillow portion 1 positioned in the upper portion of the pillow and an adjustment portion 2 positioned in the lower portion of the pillow. The pillow portion 1 and the adjustment portion 2 can be integrally formed with each other, or they can also be detachably separated from each other. The adjustment portion 2 includes a planar portion 3 and an arc portion 4 connected with the planar portion 3. The planar portion 3 is connected with the pillow portion 1. If the height direction of the person lying on the pillow is taken as the longitudinal direction, then the longitudinal section of the adjustment portion 2 has the shape of the letter "D", and the cross section thereof has a rectangle shape. The pillow according to the present invention has the maximum longitudinal thickness at the longitudinal central position of the pillow, and the longitudinal thickness thereof becomes smaller at both of its farther edges as compared to the longitudinal central position.

When the user lies on his side, it is necessary to have the portion from outside of the head and neck to the outer side of the shoulder supported on the pillow since he contacts the bed surface with his shoulder. At this time, the gravity point of the head is close to the central position of the arc portion 4, that is, the position at which the adjustment portion 2 has the maximum thickness. When the user lies on his back, it is necessary to have the portions from the lower side of the head and the neck to the back supported on the pillow (though this distance is less than the distance supported on the pillow when the user lies on his side) since he contacts the bed surface with his back. At this time, the gravity point of the head moves in the longitudinal direction to the pillow edge, that is, the thickness of the adjustment portion is reduced to be suitable for the reduce in the distance supported by the pillow. In this way, the height of the pillow according to the present invention can be self-adjusted in accordance with the changes of the sleeping posture during the sleeping process, so as to meet the supporting distance that the pillow provides and enables the head and the neck to be supported in the most comfortable manner, while not subjected to a spring-back pressure, it will ensure that the blood circulation works smoothly in the head and neck portions and thereby a high-quality sleep is achieved for the user.

In a preferred embodiment, the curve of the outer upper surface of the pillow portion 1 is matched with the curve of the head, the neck and the shoulder of the person. The maximum height of the adjustment portion is about 5 cm.

In another preferred embodiment, the size of the lower surface of the pillow portion 1 is slightly larger than the corresponding size of the planar portion 3 connected therewith.

In further another preferred embodiment, one or more adjustment thin layers can be included between the pillow portion 1 and the adjustment portion 2, so as to increase the total height of the pillow. The adjustment thin layers may be formed of the same materials as that of the pillow portion 1.

Although the description of the present invention is made with reference to the preferred embodiments, the present invention is not limited to these embodiments. Various modifications and changes can be made to the invention by those skilled in the art without departing from the spirit and scopes of the present invention.

What is claimed is:

1. A method for self-adjusting the height of a pillow where the pillow receives the gravity point of an user's head, the method comprising:

providing a pillow having pillow portion with an upper surface and a lower surface and a non-inflatable adjustment portion, wherein the non-inflatable adjustment portion is made of a single piece and includes a planar and flat upper surface and an arc-shaped lower surface connected with said planar and flat upper surface; the planar and flat upper surface is connected with and covers the entire central area of the lower surface of the pillow portion; and a longitudinal section of the non-inflatable adjustment portion has a shape of the letter "D" when a height direction of the person lying on the pillow is taken as a longitudinal direction;

determining the shape of the longitudinal section and the maximum height of the non-inflatable adjustment portion so that, when an user lies on his side, the gravity point of the user's head is close to the central position of the longitudinal section, where the non-inflatable adjustment portion has its maximum height, and when the user lies on his back, the gravity point of the user's head moves in the longitudinal direction toward the edge of the self-adjusting pillow, where the non-inflatable adjustment portion has a height less than its maximum height.

* * * * *